United States Patent [19]

Kan

[11] Patent Number: 5,055,805

[45] Date of Patent: Oct. 8, 1991

[54] HIGH SPEED POLARIZATION SWITCH ARRAY FOR SELECTING A PARTICULAR ORTHOGONAL POLARIZATION

[75] Inventor: Philip T. Kan, Yorba Linda, Calif.

[73] Assignee: Rockwell International Corporation, El Segundo, Calif.

[21] Appl. No.: 416,192

[22] Filed: Oct. 2, 1989

[51] Int. Cl.[5] ..... H01P 1/161

[52] U.S. Cl. ..... 333/21 A; 333/250; 333/258; 343/756

[58] Field of Search ..... 333/21 A, 250, 258; 343/756, 909

[56] References Cited

U.S. PATENT DOCUMENTS

| | | | |
|---|---|---|---|
| 3,189,722 | 6/1965 | Fritz | 333/21 A X |
| 3,708,796 | 1/1973 | Gilbert | 343/756 X |
| 4,212,014 | 7/1980 | Chekroun | 343/909 X |
| 4,266,203 | 5/1981 | Saudreau et al. | 333/21 A |
| 4,518,966 | 5/1985 | Sadones | 343/909 X |
| 4,595,890 | 6/1986 | Cloutier | 333/21 A X |
| 4,754,243 | 6/1988 | Armstrong et al. | 333/250 |

*Primary Examiner*—Eugene R. LaRoche
*Assistant Examiner*—Benny Lee
*Attorney, Agent, or Firm*—H. Frederick Hamann; George A. Montanye; Gregory D. Ogrod

[57] ABSTRACT

An apparatus is disclosed comprising a polarization mode selection switch for preselected wavelengths using a waveguide having a first array of PIN type diodes mounted in a plane extending substantially perpendicular to a longitudinal waveguide axis. The diodes are disposed at one-quarter wavelength intervals along a first series of parallel lines which are separated at about one-half wavelength intervals. A second PIN diode array is also mounted within the waveguide in a second plane extending substantially perpendicular to the waveguide axis with diodes disposed at one-quarter wavelength intervals along a second series of parallel lines that are also spaced about one-half wavelength apart. The second plane is substantially parallel and adjacent to the first plane with the second lines being oriented substantially perpendicular to the first lines. The diodes are mounted on opposite surfaces of a planar substrate made from quartz or plastic and interconnected with conductive material such as thin metal foil or strips. The diodes can be formed by discrete beam lead PIN diodes or by depositing appropriate layers of P-type, intrinsic, and N-type semiconductor materials adjacent to each other on the substrate. Polarization modes are selected by forward biasing lines of diodes in one array to short or shunt polarization modes aligned with conduction paths in that array.

12 Claims, 6 Drawing Sheets

TO PIN DIODE DRIVER (X – POLARIZATION)

HIGH SPEED POLARIZATION SWITCH ARRAY FOR SELECTING A PARTICULAR ORTHOGONAL POLARIZATION

BACKGROUND OF THE INVENTION

1. Field of the Invention

The present invention relates to polarization selection or switching and more particularly to a high speed polarization switch which selects between predetermined polarization modes for electromagnetic radiation transferred through a waveguide. The invention further relates to a polarization switch using diode arrays for selectively shorting predetermined polarization modes.

2. Related Technical Art

It is often desirable to select between or preferentially monitor different polarization modes in received electromagnetic radiation signals. This is often done as a means for extracting or inferring information from received signals through isolation of specified polarization modes in which the information is embedded. Also, inter-signal interference may be decreased by attenuation of some polarization modes.

In the area of high frequency radar, radiation reflected by most targets is generally found to have consistent polarization characteristics dependent upon the reflection medium. That is, when reflecting a radar signal comprising multiple polarization modes, metallic targets with extensive planar surfaces typically return substantially mono-polar radiation, or radiation having a single polarization mode. Planar metallic surfaces provide isolation into singular polarization modes due to the nature of radiation interactions with the surface. On the other hand, general background or "clutter" type reflection sources tend to return radiation that is more randomly distributed among two or more polarization modes. Therefore, polarization mode detection can be applied in the analysis of radar signals to help differentiate between "true" targets and "false" targets, especially in the presence of undesirable clutter.

Polarization mode detection is a useful feature to incorporate in advanced target acquisition systems to allow monitoring of polarization modes of reflected or received radiation to determine changes as a function of seeker or detector direction. However, detecting polarization modes in received radiation requires filtering or removal of some modes while the relative strength of remaining modes is detected.

In the case of circularly polarized radiation, polarization mode removal is generally accomplished by transferring received radiation through a polarization selective switch that shorts out or shunts undesired modes. Such switches typically comprise a series of gratings which are aligned with one mode and act to shunt or short out that mode. The gratings can be implemented using a series of fine wires, wire mesh, metal grids, or slotted plates. However the grids must be mechanically oriented and redirected or isolated, to dynamically select between different polarization modes. Mechanical operation imposes a significant penalty in terms of response time. It can take on the order of one millisecond or more to mechanically change grid orientation. At the same time, a mechanical approach also requires a substantial amount of working volume and complexity to implement. This may impact reliability and reproducibility.

For commercial and military applications, volume, speed and reliability are key factors in the design of advanced radar detection and analysis equipment. Advanced avionics designs demand minimum volume and weight in radar equipment to meet changing airframe aerodynamics and weight limitations. Other types of radar systems including space borne and naval applications also require ever smaller volumes. At the same time, there is a desire for faster response in mode selection and analysis. Current polarization mode selection techniques or approaches are not satisfactory for many of these applications and provide limited flexibility in equipment design.

What is needed is a method or apparatus for polarization mode selection which operates at high speeds, in minimum volumes, and with a minimum of complexity.

SUMMARY

In view of the shortcomings found in the art, one purpose of the present invention is to provide polarization mode selection in a highly compact volume.

Another purpose of the present invention is to select between a plurality of polarization modes at very high speeds.

An advantage of the present invention is that it operates at very high speeds and frequencies.

Another advantage of the present invention is that it has a very low physical impact on associated system volume.

Yet another advantage of the present invention is improved reliability at higher speeds.

These and other purposes, objects, and advantages are realized in a polarization mode selection switch for selecting between multiple polarization modes in received electromagnetic radiation of preselected wavelengths, comprising a waveguide for transferring the electromagnetic radiation along a predetermined longitudinal waveguide axis with a first array of PIN type diodes mounted within the waveguide in a plane extending substantially perpendicular to the waveguide axis. The diodes are disposed at intervals of about one-quarter of a wavelength of interest along a first series of parallel lines which are separated at intervals of about one-half of the wavelength. A second array of PIN type diodes are also mounted within the waveguide in a second plane extending substantially perpendicular to the longitudinal waveguide axis. The second diodes are disposed at one-quarter wavelength intervals along a second series of parallel lines that are spaced apart at about one-half wavelength intervals. The second plane is substantially parallel and adjacent to the first plane with the second lines being oriented substantially perpendicular to the first lines.

The diodes are preferably attached on a support in the form of a thin planar substrate mounted in the waveguide and positioned transverse to the longitudinal axis. The substrate is substantially transmissive of electromagnetic radiation at the wavelengths of interest and typical substrate materials are quartz or plastic. In the preferred embodiment, the substrate is circular and is mounted within a circular or cylindrical mounting region in the waveguide. In this configuration, each series or set of diode lines form parallel chords with one being a diameter.

In a preferred embodiment, the diodes comprise small, beam lead PIN type diodes mounted on opposite surfaces of the substrate at the one-quarter wavelength intervals along the desired lines. In an alternate embodiment, the diode arrays comprise a monolithic structure where appropriate layers of P-type, intrinsic, and N-type semiconductor materials are deposited on the substrate adjacent to each other so as to form PIN-type diodes. The materials are deposited, using known masking techniques, in the locations designated for the diodes on each of the substrate surfaces.

Within each array of diodes, along each line, the diodes are connected to adjacent diodes by conductive material such as thin metal foil or strips. When the diode arrays are constructed as a monolithic structure the metal can be deposited using known manufacturing techniques to overlap and contact the PIN diode structures.

The operation of the polarization switch comprises forward biasing each line of diodes in one array to create a series of conductive paths which short or shunt electrical energy in polarization modes aligned with those paths. By selectively, mutually exclusive biasing the two arrays, different modes are selected for transfer through the waveguide.

The selection of the diodes or diode arrays is accomplished by connecting each line of diodes, in each array, to a biasing power source using a resettable bias controller. The controller can be manually actuated or electrically programmable. The controller typically comprises a series of electrically operable switches coupled to the lines of diodes by a series of conductors through electrical feedthroughs in the waveguide sidewalls. The controller connects the diodes to a bias power source or power supply capable of delivering a predetermined voltage for forward biasing diodes and accommodating any energy deposited by the shunted polarization modes as desired.

BRIEF DESCRIPTION OF THE DRAWINGS

The novel features of the present invention may be better understood from the following description when taken in conjunction with the accompanying drawings in which like characters refer to like parts and in which.

DETAILED DESCRIPTION OF A PREFERRED EMBODIMENT

The present invention provides an apparatus and method for selectively transferring dynamically selected or predetermined polarization modes of electromagnetic radiation through a waveguide. The apparatus of the invention provides this selection at high switching speeds and in a minimum volume. This is accomplished by positioning two planar diode arrays on opposite sides of a radiation transmissive substrate which is mounted inside of a waveguide. Both the substrate and the waveguide are transmissive of radiation at predetermined frequencies such as 94 GHz. Each planar array is composed of linear diode arrays which are spaced apart at sub-wavelength intervals and oriented along selected polarization mode axis in order to selectively shunt correspondingly oriented polarization modes.

The invention is described in relation to circularly polarized radiation and for use with millimeter-wave frequency devices. However, it may find application to monitoring other polarization modes in received radiation, and at a variety of frequencies as desired. Those skilled in the art will readily understand the dimensions required to use the teaching of the disclosure at other frequencies and for other polarization modes.

Figure 1:
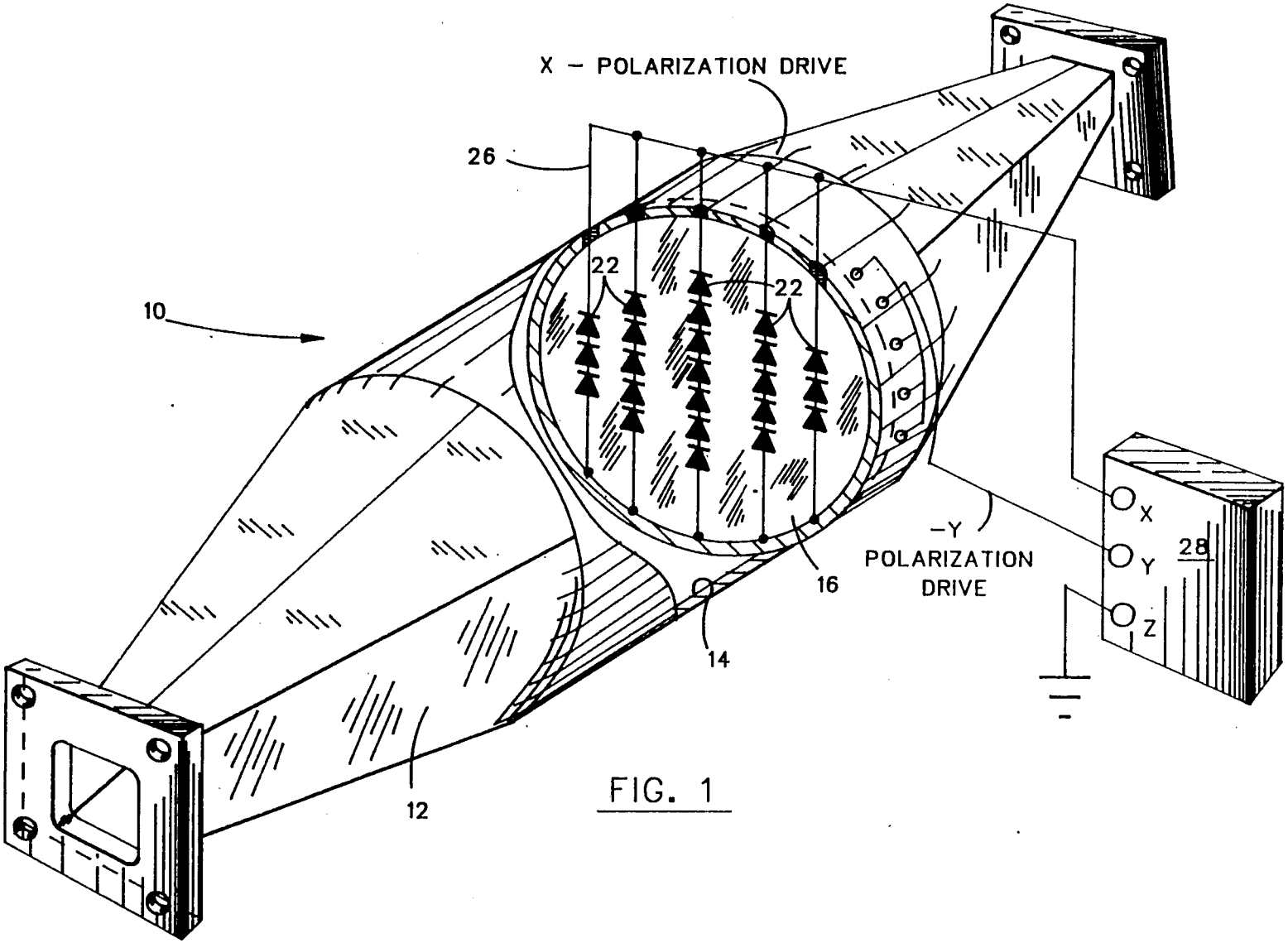
FIG. 1 illustrates a perspective view of a polarization selector constructed and operating according to the principles of the present invention with a cut-away mid-section..

A polarization mode selection switch constructed according to the principles of the present invention is illustrated in a perspective view in FIG. 1 In FIG. 1, a polarization selection switch 10 is shown which comprises a shell or housing 12 which has walls with conductive interior surfaces which form a waveguide 14. This can be accomplished by using metallic materials to construct the housing 12 or by coating the interior surfaces with a suitably conductive material.

As shown in FIG. 1, the walls of the housing 12 are configured to have a generally circular cross section at a midpoint and a rectangular cross section on opposite ends. This configuration is employed to allow interfacing with typical, rectangular cross section, waveguides found in high frequency applications, such as radar, while implementing the diode arrays disclosed below. The rectangular end sections generally employ a flange with bolt holes for securing the housing 12 to existing waveguide apparatus.

As illustrated in further detail in the cross section of FIG. 1, a substrate 16 is mounted within the central portion of the waveguide 14. The substrate 16 is secured in place using a variety of known techniques including mounting brackets or bonding compounds. A groove, lip, or ridge may also be provided in the walls of the housing 12 to help support the substrate 16. The specific mounting technique chosen depends on the design constraints imposed by the specific application (mechanical stress, space, cost, period of use) as will be apparent to those skilled in the art.

The substrate 16 comprises a material such as, but not limited to, quartz or plastic, which is highly transmissive of the wavelength of radiation of interest. However, it will be recognized by those skilled in the art that other materials may be suitable for this support structure depending on the operating frequencies chosen for the waveguide 14. Any material inserted into a waveguide will impact the attenuation of the waveguide and care must be made to use as minimum a dimension for the thickness of the substrate 16 as possible. For frequencies on the order of 94 GHz, the quartz plate used for the substrate 16 is made on the order of five to ten thousandths (0.005–0.010) of an inch or less thick. Thicker substrates may be allowed for other applications depending on allowable insertion losses.

Secured on opposite surfaces 18*a* and 18*b* (see FIG. 26) of the substrate 16 are two dimensional diode arrays which act as mode shunts or switches In the present invention, the diode arrays are configured to short or shunt preselected polarization modes of circularly polarized radiation traversing the waveguide 14.

Figure 2A:
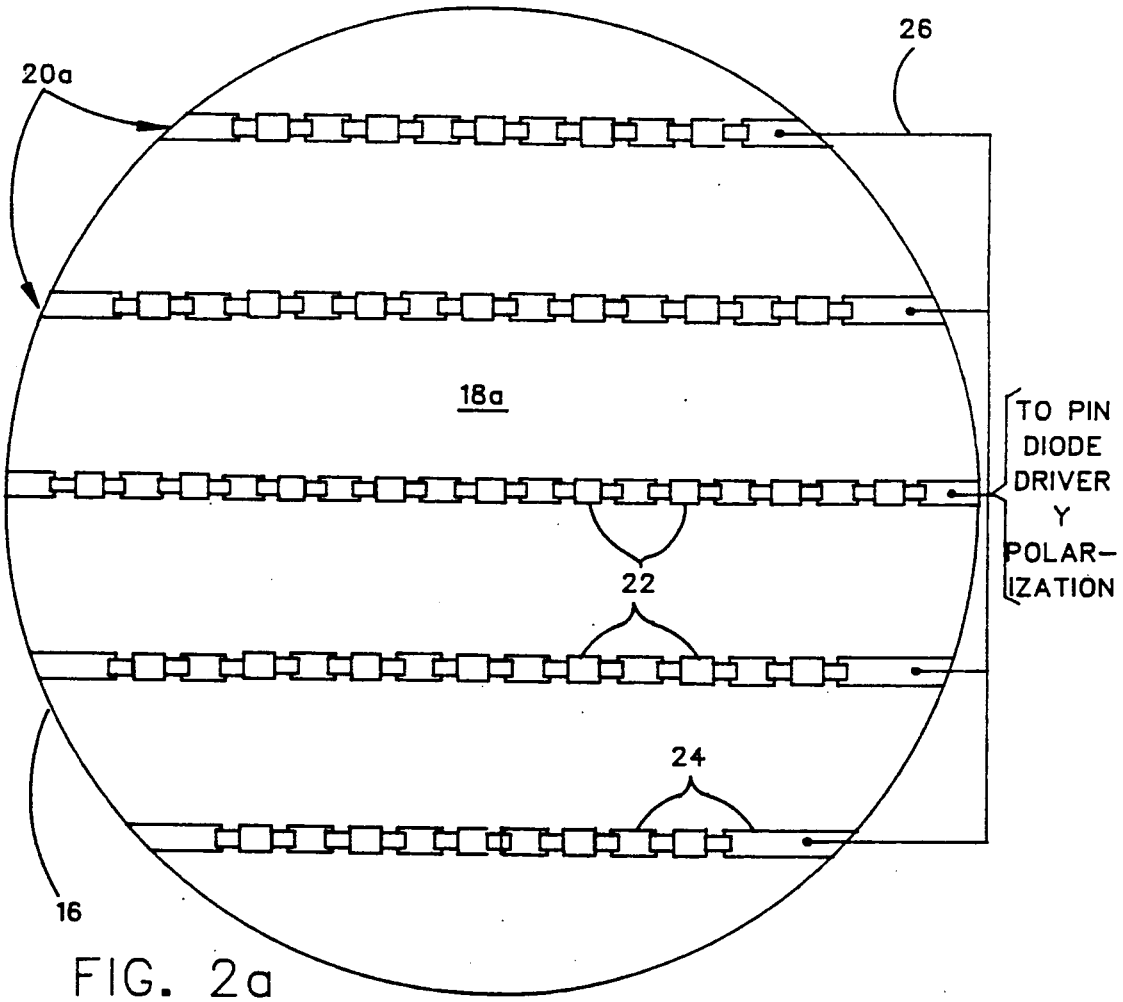
FIGS. 2*a*, 2*b*, and 2*c* illustrate top, side, and bottom views of the diode arrays employed in the selector of FIG. 1.
Figure 2B:
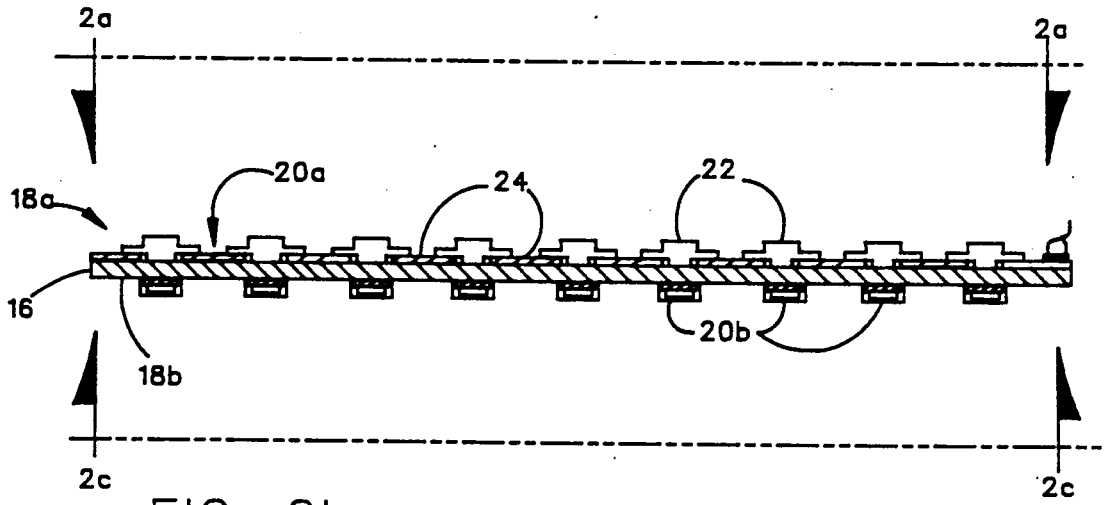
Figure 2C:
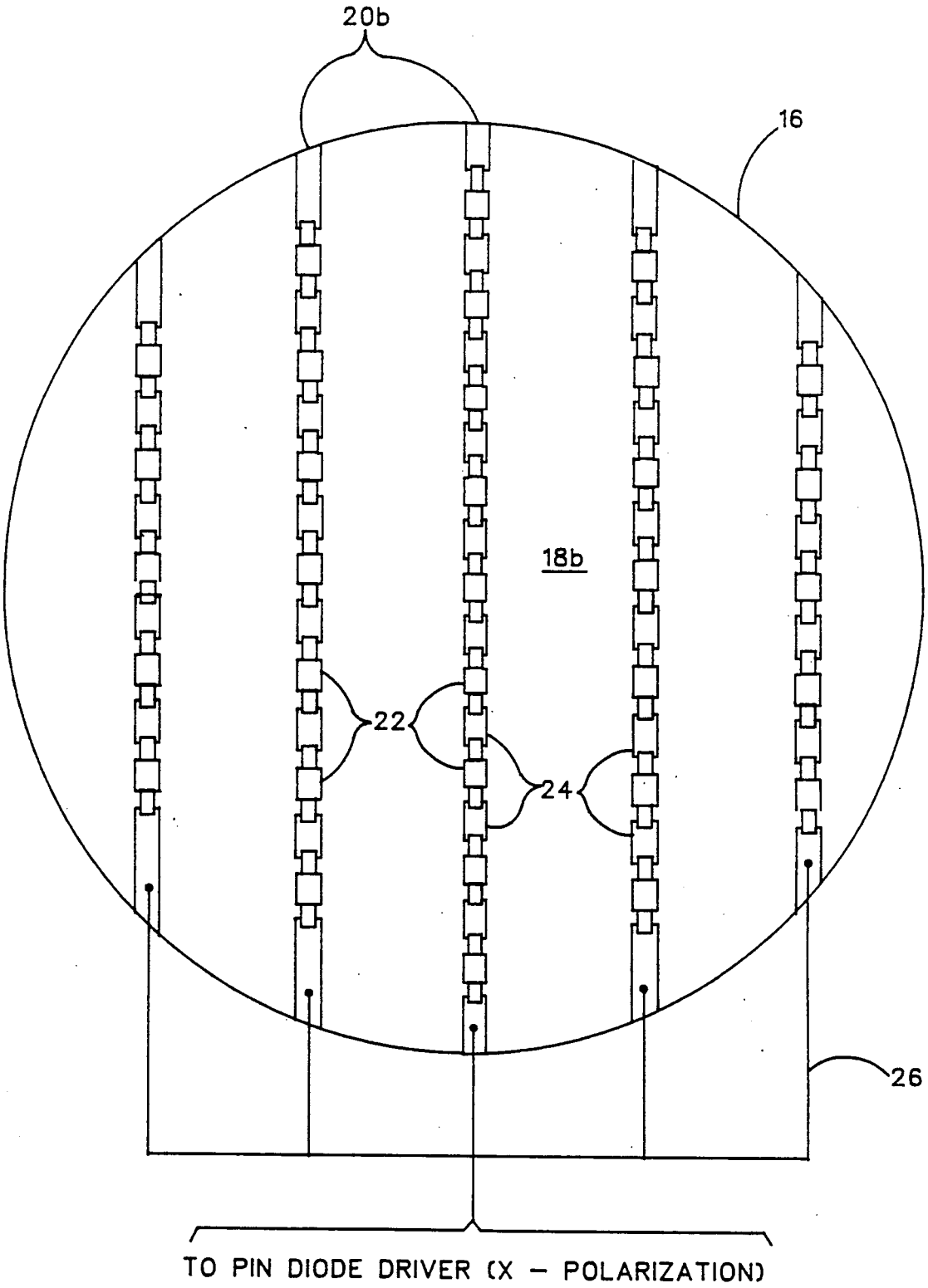

As seen in more detail in FIGS. 2*a*–2*c*, each two-dimensional diode array comprises a series of PIN type diodes 22 that are positioned in parallel lines or linear arrays 20*a* or 20*b* across one surface of the substrate 16. The diodes 22 can be secured to the substrate 16 using known manufacturing techniques. Examples of such techniques include bonding agents and adhesives disposed between the diodes 22 and the substrate 16 surface. In addition, diode interconnection metal or conductors 24, see below, formed on the surfaces 18 of the substrate 16 between the PIN diodes 22 may be used to facilitate mounting and securing the diodes to the substrate surface.

PIN diodes are manufactured or available in a variety of housings and configurations. In the preferred embodiment, the PIN diodes 22 comprise diodes manufactured using beam leads to access the device junctions. An exemplary commercially available diode found useful in constructing the invention is a GaAs type PIN diode manufactured by M/A-COM Semiconductor Products Operation in Burlington, Massachusetts under the designation MA46P022 The overall dimensions for this type of beam lead diode are typically 0.035 inches long, 0.007 inches wide, and 0.004 inches thick.

The diodes 22 are mounted on the substrate 16 in straight lines spaced apart across the surfaces 18*a* and 18*b*. That is, linear arrays or lines 20 of diodes 22 are aligned along parallel chords, typically including a diameter, extending across the surfaces 18*a* or 18*b*. To accommodate or transfer electromagnetic radiation of predetermined or desired wavelengths, the linear arrays or lines 20, are separated from adjacent arrays by about one-half the desired wavelength to be transferred by the waveguide 14. Furthermore, the diodes 22 are spaced apart along each selected chord at approximately one-quarter wavelength intervals, for the wavelength of interest. This separation is chosen so that radiation is transferred through a chosen diode array without substantial interaction or attenuation unless desired.

For the millimeter length wavelengths of principle interest (at a frequency of about 94 GHz). the proposed one-quarter and one-half wavelength separations translate to about 1 and 2 millimeters respectively. At such frequencies or wavelengths, the waveguide 14 is generally on the order of 10 millimeters in diameter in the region of the substrate 16. While it is desirable to achieve a spacing as close to the one-quarter wavelength as possible those skilled in the art will recognize that deviations affect efficiency and insertion losses but not the absolute operability of the present invention.

As shown in FIGS. 2*a*–2*c* (see also FIGS. 1, 3*a*–3*c*) the diodes 22 form parallel linear arrays 20*a* and 20*b* (parallel chords) on each of the surfaces 18*a* and 18*b*, respectively. However, the linear arrays on the surface 18*a* are not parallel to those on the surface 18*b*. That is, the surfaces 18*a* and 18*b* form parallel support planes for the diodes but the linear arrays on surface 18*a* extend in a series of lines that are substantially perpendicular to the linear arrays on surface 18*b*.

The diodes 22 in each linear array 20*a* or 20*b*, or along each line, are electrically connected together to form a conductive path when the diodes are forward biased. This interconnection is accomplished by mounting thin metal foils or strips of material 24 onto the substrate 16 between the diodes 22. Alternatively, the metal is applied to the substrate 16 using masking and etching or known deposition techniques to directly form a conductive strip. Where desired metal is deposited to directly overlap the edge or contact of the diode structures, or small bond wires or jumpers can be used to bridge between the metal and diodes.

Electromagnetic radiation intercepted by each activated diode array is shorted between the side walls of the waveguide 14 or to external contact points or feedthroughs for the waveguide 14. Therefore, electromagnetic radiation whose polarization mode orientation aligns with an activated diode array. 20*a* or 20*b*, is shunted and removed while other polarization modes remain substantially unaffected.

Figure 3A:
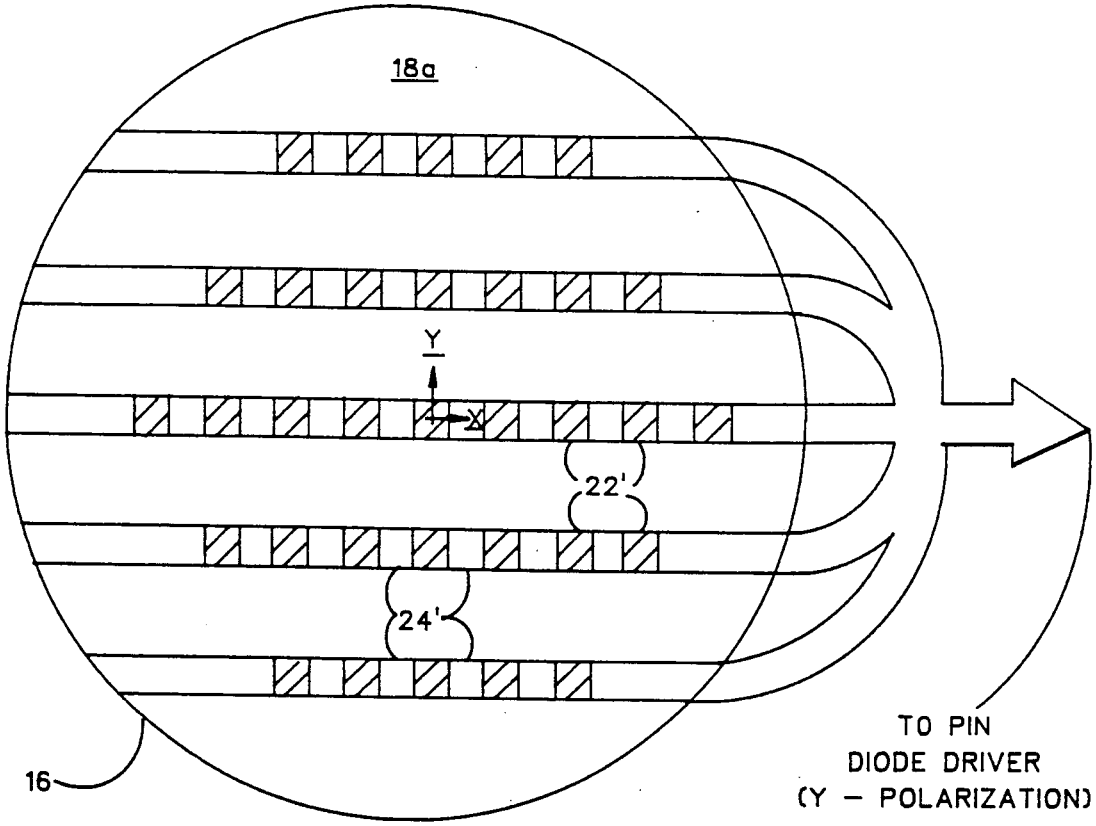
FIGS. 3*a* 3*b*, 3*c* and 3*d* illustrate top, side, and bottom views of diode arrays for use in the apparatus of FIG. 1 wherein the arrays are constructed as a monolithic structure, with FIG. 3*c* providing an enlargement of a portion of FIG. 3*b*.
Figure 3B:
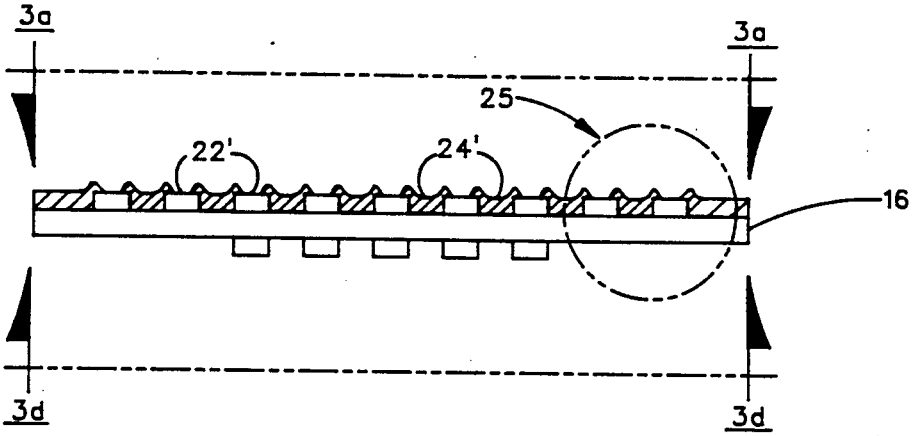
Figure 3C:
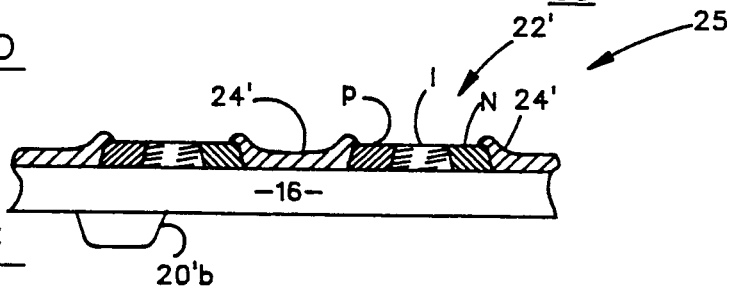
Figure 3D:
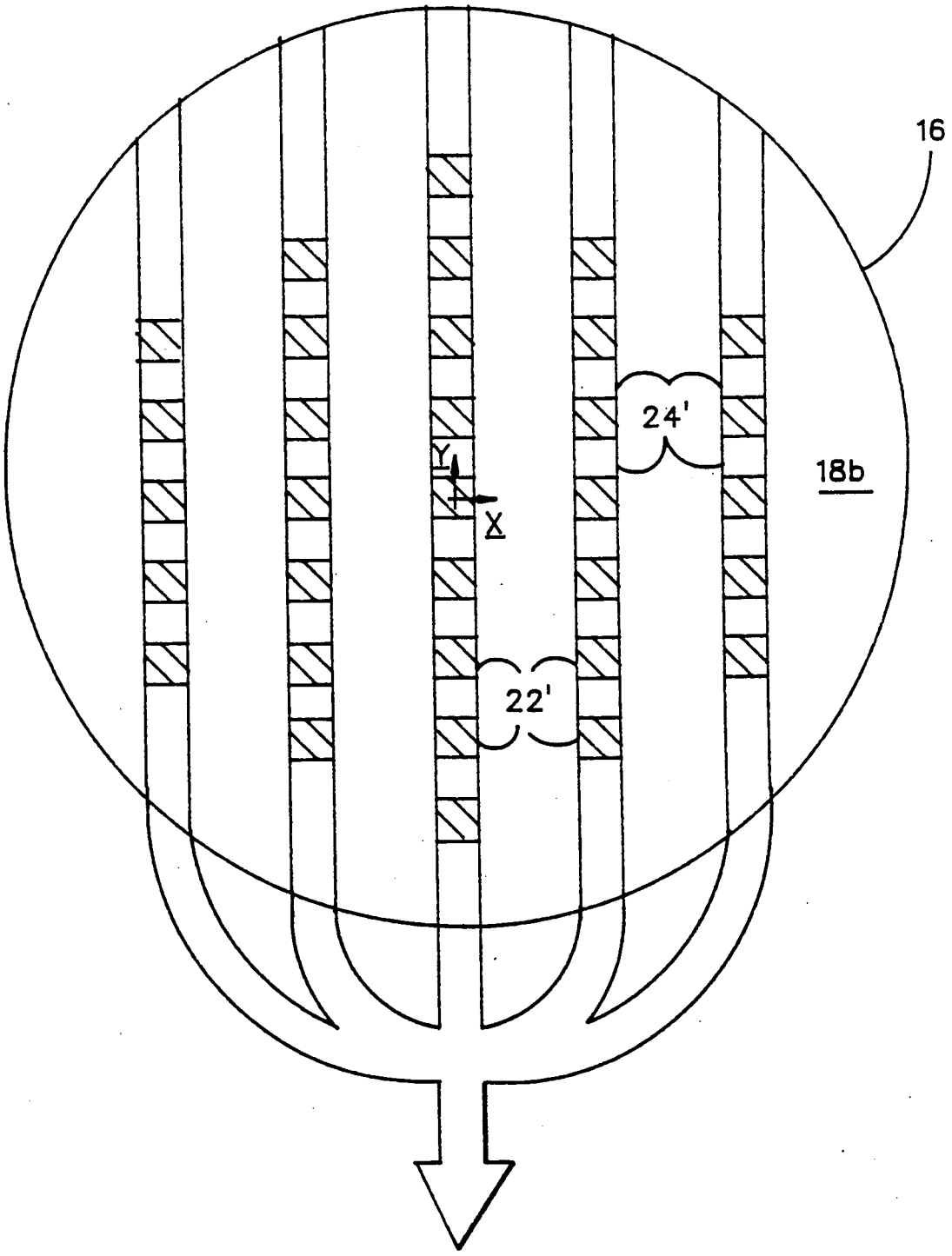

In an alternate embodiment volume may be reduced for some applications and operating power decreased by forming a monolithic diode array structure. This embodiment is illustrated in the top, side, and bottom views of FIGS. 3*a*, 3*b*, and 3*d*. In this approach the quartz substrate 16 is used as a base on which the diodes for the arrays 20'*a* and 20'*b* are directly formed in the desired diode array pattern. That is, locations where the diodes are desired to be located on the surfaces 18*a* and 18*b* are designated and the remaining area masked off, covered, or protected from deposition. The PIN diodes 22', are then manufactured in place by depositing required materials, in layers, in the designated locations to form p-type. n-type, and intrinsic region layers. This is shown in further detail in FIG. 3*c* where the region 25 of FIG. 3*b* is shown enlarged. The semiconductor material required to form the PIN diodes can be deposited on the quartz substrate 16 using known manufacturing techniques and processes and interconnected to achieve the linear arrays. In FIG. 3*c*, a layer or region of P-type semiconductor material, here labeled as P, is shown as deposited on the surface of the substrate 16 at locations desired for each diode 22''(or 22). Next to this material, a layer or region of intrinsic-type semiconductor material labeled I) is deposited, followed by an N-type material (labeled N). The metal interconnect material 24'is then deposited on the substrate 16 so as to overlap or about the P and N-type material. The structure of FIG. 3*c* is for purposes of illustration only and those skilled in the art will readily understand that other material configurations may be used to create the PIN diodes 22' such as where stray capacitances are being minimized, etc.

The diodes thus formed are positioned on the substrate at quarter wavelength intervals and do not require special bonding or soldering to secure in place. In addition, these diodes may use less volume than discrete diode components. At the same time, thin wire or diode interconnection metal can be deposited on the substrate 16 using known deposition and masking or etching techniques. In this embodiment, a thinner substrate B can be used for support on the order of one thousandth (0.001) of an inch thick.

As shown in FIG. 1, the diodes 22 or 22' are connected on the end of each linear array 20 to a controller 28 through a series of one or more conductors 26. The conductors 26 feed through the sidewall of the waveguide 14 where they are connected to the polarization controller 28. The conductors 26 are electrically isolated or insulated from the sidewalls of the housing 12. Those conductors 26 connected to a diode array aligned with the y axis or polarization plane of the waveguide 14, are connected to an x polarization mode selection input, labeled X, of the controller 28. The diode arrays aligned with the y axis will short out y polarization modes leaving the x polarization modes. THose conductors 26 connected to a diode array aligned with the x axis or polarization plane of the waveguide 14, are connected to a y polarization mode input, labeled Y, of the controller 28. The controller 28 also provides a ground connection, labeled Z, for connection to the waveguide 14 ground to ensure a common potential. The controller 28 comprises control elements known in the art for such a control function such as, but not limited to, a microprocessor operating under program control and a serial of solid state switches or relays.

Figure 4:
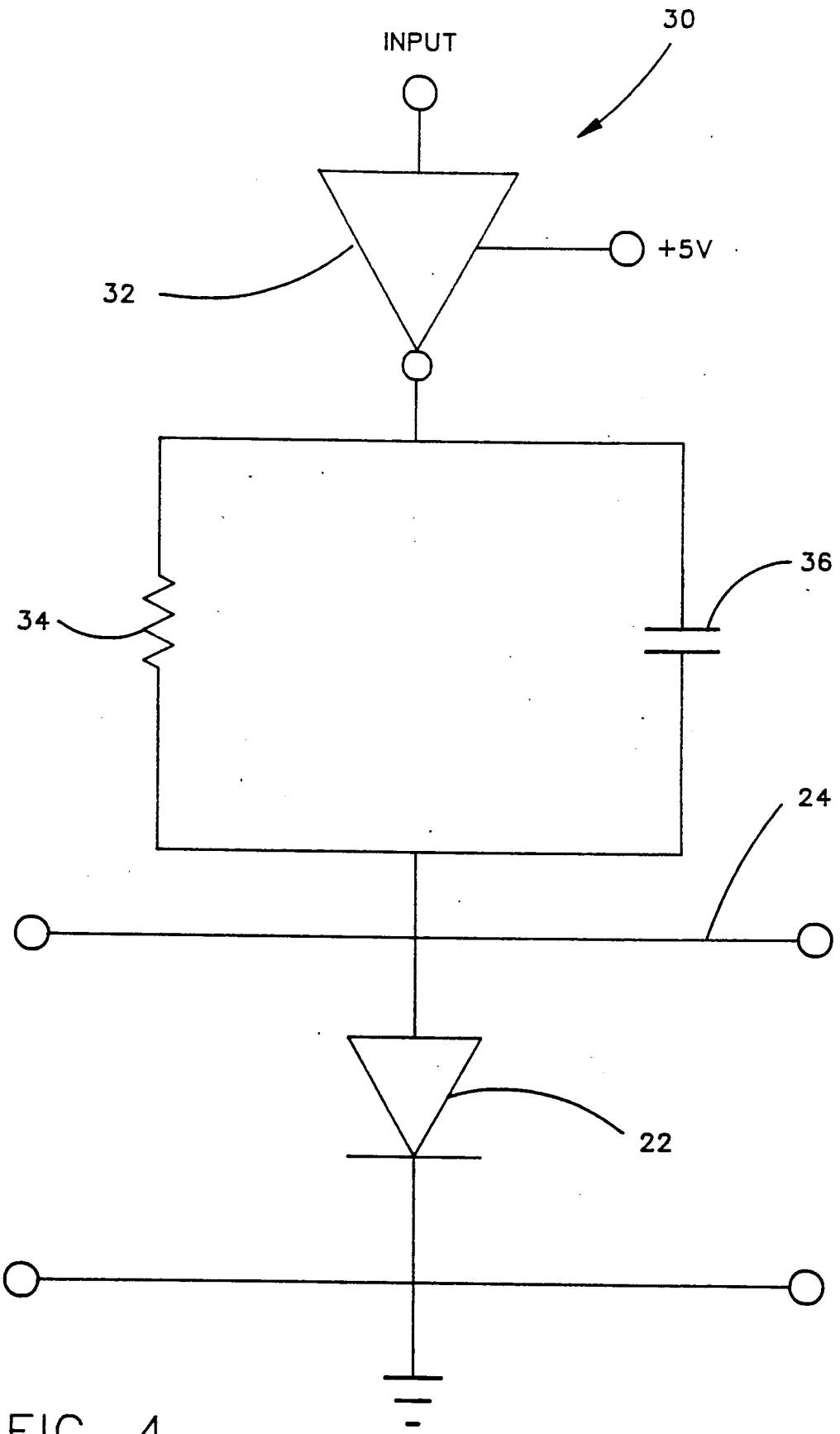
FIG. 4 illustrates a typical diode driver circuit for use with the apparatus of FIG. 1.

An exemplary control element 30 for use in the controller 2B is illustrated in schematic form in FIG. 4. In FIG. 4, an input control signal for activating one or more diodes 22 is applied to an input buffer 32 which is connected to a 5 volt DC power source. The buffer 32 generally uses an inverted output voltage level. The output of the buffer 32 is applied to a resistor 34 and a capacitor 36 which are in parallel with each other and in series with the buffer 32 output. Control signals applied to the buffer 32 cause the appropriate DC bias voltage to be transferred by the resistor 34 and capacitor 36 to the diode 22. The control element 30 typically utilizes a ground at the same potential as the walls of the waveguide 14. Therefore, one end of the diode arrays is connected to the element 30 and the other to the walls 12. However where desired, the second ends of the linear arrays 20 can also be isolated from the walls and connected to the controller 28 or other ground points.

The controller 28 is instructed, either manually or through a pre-programmed software or firmware instruction set, to apply control signals to the control elements 30 which selectively bias the ends of the desired linear arrays 20 with a DC voltage sufficient to forward bias the diodes in that array. This in turn creates a low resistivity electrically conductive path. The selection of linear arrays in either diode array **20*a* or 20*b***. thus, shorts polarization modes along the axis of that selected array.

The biasing of the arrays **20*a* and 20*b***, can as stated, be manually achieved or automated so as to be modulated at a predetermined frequency or in a desired pattern so as to provide specified scanning patterns in received radiation, and therefore, mode selection.

The foregoing description of preferred embodiments have been presented for purposes of illustration and description. It is not intended to be exhaustive nor to limit the invention to the precise forms disclosed, and many modifications and variations are possible in light of the above teaching.. The embodiments were chosen and described to best explain the principles of the invention and its practical application to thereby enable others skilled in the art to best utilize the invention in various embodiments and with various modifications as are suited to the particular use contemplated. It is intended that the scope of the invention be defined by the claims and their equivalents.

What is claim as my invention is:

1. A method of selecting between polarization modes in received electromagnetic radiation of preselected wavelength, comprising the steps of:

transferring said radiation through a waveguide along a longitudinal waveguide axis;

positioning a planar substrate which is substantially transmissive of said electromagnetic radiation in said waveguide substantially perpendicular to said longitudinal axis;

disposing a first array of PIN type diodes on a first side of said substrate along a first series of parallel lines which are spaced apart about one-half of said wavelength, said first diodes being disposed at one-quarter wavelength intervals along each of said parallel lines;

disposing a second array of PIN type diodes on a second side of said substrate, which is parallel to said first side, along a second series of parallel lines which are spaced apart about one-half of said wavelength, said second diodes being disposed at one-quarter wavelength intervals along each of said parallel lines with said lines being oriented substantially perpendicular to said first lines; and selectively forward biasing diodes in only one array at any one time, said diodes being forward biased on said first side to effect conduction along said first parallel lines to select a first polarization mode, and on said second side to effect conduction along said second parallel lines to select a second polarization mode.

2. The method of claim 1 wherein said substrate comprises material chosen from the group consisting of quartz and plastic.

3. The method of claim 1 further comprising the steps of mounting beam lead PIN type diodes on opposite surfaces of said substrate at one-quarter wavelength intervals along said lines and interconnecting said diodes with electrically conductive material.

4. The method of claim 1 wherein said steps of disposing first and second diode arrays further comprise:

forming a first and second plurality of diodes on first and second surfaces of said substrate, respectively, as said first and second arrays, in predetermined locations desired for said diodes, said formation comprising the steps of:

depositing a layer of P-type semiconductor material in a portion of said locations;

depositing a layer of intrinsic semiconductor material in said locations adjacent to and in contact with said P-type material; and depositing a layer or N-type semiconductor material in said location adjacent to and in contact with said intrinsic-type material so as to form PIN type diodes in said locations.

5. The method of claim 4 further comprising the step of depositing an electrically conductive material between said diodes along said lines so as to form conductive paths along said lines.

6. The method of claim 1 further comprising the steps of:

connecting a plurality of electrical conductors to said lines of diodes;

providing a bias power source capable of delivering a predetermined voltage for forward biasing diodes in said first and second arrays;

selectively coupling said conductors to said biasing power source; and biasing said first and second arrays of diodes dependent upon which polarization mode is desired.

7. A polarization mode selection switch for selecting between two or more polarization modes in received electromagnetic radiation of a preselected wavelength, comprising:

a waveguide for transferring said electromagnetic radiation along a predetermined longitudinal waveguide axis, said waveguide having a portion with a circular cross-section.

a planar, circular, substrate mounted within said waveguide circular portion positioned transverse to said longitudinal axis and being substantially transmissive of said electromagnetic radiation;

a first plurality of PIN type diodes mounted on a first side of said substrate along a first series of parallel lines with said first series of parallel lines being spaced apart at intervals of about one-half of said wavelength, said diodes being spaced apart at about one-quarter wavelength intervals along each of said lines;

a second plurality of PIN type diodes mounted on a second side of said substrate, which is parallel to said first side, along a second series of parallel lines with said second series of parallel lines being spaced apart about one-half of said wavelength, said diodes being spaced apart at about one-quarter of said wavelength intervals along each of said lines, said second lines being oriented substantially perpendicular to said first lines;

interconnection means for electrically connecting adjacent diodes to each other along each one of said parallel lines; and selection means for selectively forward biasing, at any one time, didoes in only one of said plurality of diodes, said diodes being forward biased on said first side to effect conduction along said first parallel lines to select a first polarization mode, and on said second side to effect conduction along said second parallel lines to select a second polarization mode.

8. The polarization switch of claim 7 wherein said first and second pluralities of diodes comprise a monolithic structure comprising:

a first plurality of predetermined locations desired for said first plurality of diodes on said first surface of said substrate;

a second plurality of predetermined locations desired for said second plurality of diodes on said second and opposing surface of said substrate;

a layer of P-type semiconductor material disposed in a portion of said locations;

a layer of intrinsic semiconductor material disposed in said locations adjacent to and in contact with said P-type material, a layer of N-type semiconductor material disposed in said locations adjacent to and in contact with said Intrinsic type material.

9. The polarization switch of claim 7 wherein said selection means comprises:

a plurality of electrical conductors connected to each of said lines of diodes;

a bias power source capable of delivering a predetermined voltage for forward biasing diodes in said first and second pluralities; and switching means for selectively coupling said conductors to said biasing power source.

10. The polarization switch of claim 7 wherein said substrate comprises material in the range of 0.005 to 0.01 inches thick.

11. The polarization switch of claim 7 wherein said substrate consisting of material chosen from the group of quartz and plastic.

12. The polarization switch of claim 7 wherein said first and second pluralities of diodes comprise:

beam lead PIN type diodes mounted on opposite surfaces of said substrate spaced apart at one-quarter wavelength intervals along said lines and interconnected with electrically conductive material.

* * * * *